United States Patent [19]

McRostie et al.

[11] 3,994,394

[45] Nov. 30, 1976

[54] SHIPPING PACKAGE FOR SEMICONDUCTOR DEVICES

[75] Inventors: Peter R. McRostie, Sunnyvale; Patrick W. Shelley, Mount View, both of Calif.

[73] Assignee: Hewlett-Packard Company, Palo Alto, Calif.

[22] Filed: Oct. 2, 1975

[21] Appl. No.: 618,993

[52] U.S. Cl. ..... 206/329; 206/419

[51] Int. Cl.[2] ..... B65D 73/02; B65D 85/30

[58] Field of Search ..... 206/328, 329, 330, 332, 206/418, 419

[56] References Cited

UNITED STATES PATENTS

| | | | |
|---|---|---|---|
| 3,423,717 | 1/1969 | Klier | 206/328 |
| 3,482,682 | 12/1969 | Cronkhite | 206/332 |
| 3,701,346 | 10/1972 | Patrick | 206/328 |
| 3,743,087 | 7/1973 | Wise | 206/330 |

*Primary Examiner*—Herbert F. Ross
*Attorney, Agent, or Firm*—Ronald E. Grubman

[57] ABSTRACT

A package for flat lead transistors is provided in which a raised flange provides structural rigidity to prevent damage to the flat leads of the transistor.

3 Claims, 2 Drawing Figures

SHIPPING PACKAGE FOR SEMICONDUCTOR DEVICES

BACKGROUND AND SUMMARY OF THE INVENTION

The manufacture of packages in which semiconductor devices, particularly those with flat leads, may be shipped has been a problem. Heretofore such devices have typically been shipped in packages such as polyethylene bags which offer little protection to the flat leads, or rigid boxes which offer protection but are expensive to manufacture.

In accordance with the illustrated preferred embodiment, the present invention provides a package in which semiconductor devices, including those with flat leads, may be simply contained while protection is provided against bending of the leads. The preferred structure is of a flexible material such as plastic and includes a hollow central region to house the main body of the semiconductor device, and a flat portion against which the leads of the device are contrained, e.g., by means of a strip of tape. Structural rigidity is provided to the package by an outer flange. A number of such structures may be included in a single strip, thereby enabling the efficient packaging of semiconductor devices.

DETAILED DESCRIPTION OF THE INVENTION

Figure 1:
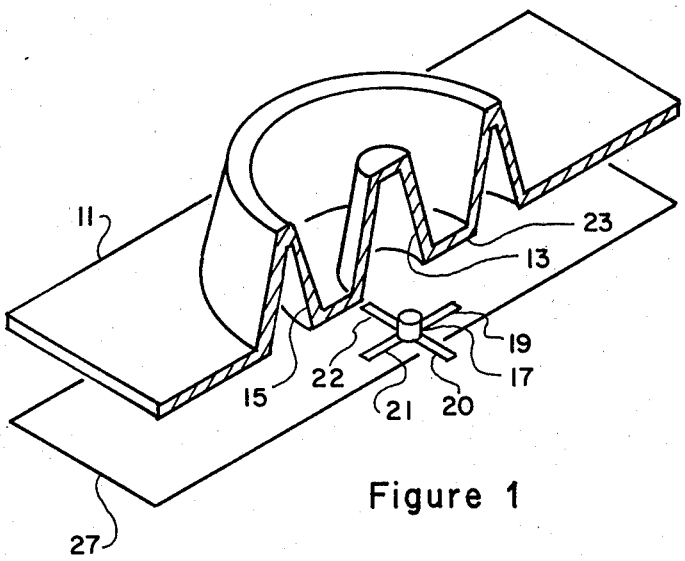
FIG. 1 is a perspective drawing including a cross-section of a preferred embodiment of a package element taken along a line A—A in FIG. 2.

In FIG. 1 there is illustrated a piece of packaging material 11, for example thin plastic sheets of thickness about 0.01 inches. A raised central area 13 and a raised ridge or flange-like portion 15 are stamped into sheet 11 in accordance with processes well known in the art. In the preferred embodiment of FIG. 1 both of the raised portions are shown as being essentially circular and having conical cross-sections. However, it will be evident to those skilled in the art that other configurations may be employed.

A semiconductor device 17 such as a microwave transistor is also illustrated in FIG. 1. Transistor 17 is shown as including four flat leads, labeled 19, 20, 21, and 22. In the packaging of transistor 17, the central portion of the transistor is fitted into central region 13 of the package. Flat leads 19, 20, 21, and 22 are brought into contact with a region 23 of the bottom of sheet 11 between raised regions 13 and 15. The transistor is held in place by a piece of restraining material 27, e.g., a thin piece of tape.

Construction of a package according to these principals provides protection against bending of the flat leads. More particularly, it has been found that the raised ridge 15 prevents bending of sheet 11 in the interior region 23 adjacent to the flat leads even when the sheet is generally subjected to bending forces. Thus, the flat leads are prevented from bending or other deformation.

Figure 2:
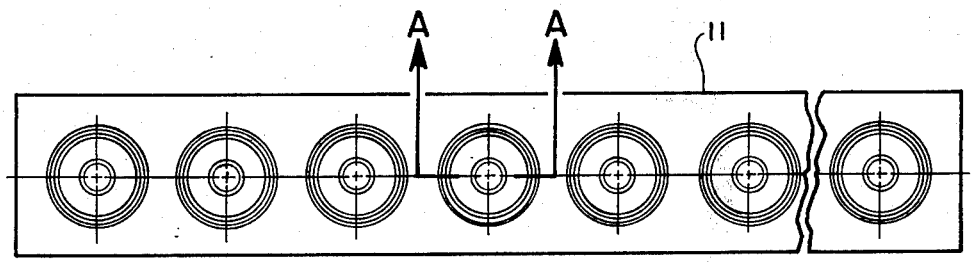
FIG. 2 illustrates a package including a number of package elements arranged in a strip.

In FIG. 2 there are shown a number of structures such as that described in FIG. 1, these structures being arranged in strip-like fashion on one piece of material 11. This arrangement makes possible the inexpensive fabrication of the package and also provides for the simple packaging of a large number of transistors.

We claim:

1. A package element for a semiconductor device having a body portion and flat leads extending therefrom, said package element comprising:

restraining means having a flat restraining surface against which the flat leads of the semiconductor device are positioned; and a strip of flexible material affixed to said restraining surface having:

a. a raised central region forming a cavity in the surface of said strip which is in contact with said restraining surface and in which the body portion of the semiconductor device is positioned;

b. a lower flat region substantially concentric with the raised central region and in contact with the restraining surface to maintain the flat leads in position against the restraining surface; and c. a raised ridge region forming an annular recess substantially concentric with said cavity and surrounding the lower flat region to prevent bending of the flat region, whereby the flat leads of the semiconductor device are protected against undesired deformation.

2. A package element as in claim 1 wherein the strip of flexible material is of plastic.

3. A package for semiconductor devices comprising a strip of flexible material including a plurality of package elements as in claim 1.

* * * * *